US005469599A

United States Patent [19]

Wurdack

[11] Patent Number: 5,469,599

[45] Date of Patent: Nov. 28, 1995

[54] SLIDE

[76] Inventor: Roy A. Wurdack, P.O. Box 613, Warrenton, Mo. 63383

[21] Appl. No.: 143,836

[22] Filed: Oct. 27, 1993

[51] Int. Cl.[6] ..... A47B 91/06

[52] U.S. Cl. ..... 16/42 R

[58] Field of Search ..... 16/42 R

[56] References Cited

U.S. PATENT DOCUMENTS

| | | | |
|---|---|---|---|
| 2,827,655 | 3/1958 | Ustica | 16/42 |
| 3,177,518 | 4/1965 | Bergstrom | 16/42 R |
| 3,183,545 | 5/1965 | Bergstrom | 16/42 R |
| 3,326,508 | 6/1967 | Born | 248/346.1 |
| 3,623,184 | 11/1971 | Mazur | 16/42 R |
| 3,883,923 | 5/1975 | England | 16/42 R |
| 5,081,740 | 1/1992 | Smith | 16/42 R |
| 5,220,705 | 6/1993 | Bushey | 16/42 R |

OTHER PUBLICATIONS

"TIVAR Means Abrasion Resistance".

Beno J. Gundlach Company Catalog 120, Copyright ©1990, p. 5, item No. 933 Easy Skids.

*Primary Examiner*—Lowell A. Larson

*Assistant Examiner*—Donald M. Gurley

*Attorney, Agent, or Firm*—Grace J. Fishel

[57] ABSTRACT

A slide to be partially inserted under the floor contact portion of a heavy structure such that the structure can be easily slid a short distance. The slide is formed as a laminar assembly including a flat plate formed of an abrasion resistant lubric plastic material such as high molecular weight polyethylene and a non-slip pad formed of a natural or synthetic plastic material such as natural rubber. The rim of the slide not under the floor contact portion tends to bend upwardly so that the heavy structure slides easily over the floor while the pad keeps the heavy structure from sliding off the slide.

4 Claims, 2 Drawing Sheets

SLIDE

BACKGROUND OF THE INVENTION

1. Field of the Invention

The present invention relates to a slide for moving heavy office files, furniture and equipment, for example, during the installation of modular carpet.

2. Brief Description of the Prior Art

Modular carpet is designed to be installed in occupied office areas with furniture and equipment in place. During installation, furniture and equipment is moved a short distance or lifted while the old flooring is removed and squares of new modular carpet installed. The office furniture and equipment is then slid or lowered into place, permitting installation of a new carpet without breaking down work stations, disrupting telecommunication or computer hookups and avoiding business interruption.

A filing cabinet, particularly lateral or fire resistant filing cabinets, are too heavy for a man to lift and very difficult to slide with some cabinets weighing 2,000 pounds or more. Such office equipment is usually moved with a hand truck, four wheel dolly or the like and takes a crew of men. The work is hard, injuries occur and labor expensive.

There are coasters for use under furniture legs to prevent denting the carpet or flooring and there are slides, primarily for home or residential use, for use under furniture legs to allow the furniture to be slid. None of these coasters or slides, however, address the problems encountered in moving heavy office furniture and equipment.

Filing cabinets are usually lined up nearly flush with a wall, spaced out only by the thickness of the cove molding. Hence the gap between the rear wall of the filing cabinet and the wall against which it sits is often no more than ¼ to ½ inch, making installation of ordinary coasters and glides impracticable by simply tipping the cabinet up and back from the front.

SUMMARY OF THE INVENTION

In view of the above, it is an object of the present invention to provide a slide, pairs of which can be inserted under the corners of a filing cabinet (or other piece of furniture or equipment), such that the cabinet can be easily slid a short distance. It is another object to provide a slide which can be used to facilitate movement of office furniture and equipment in the installation of modular carpet. Other objects and features of the invention will be in part apparent and in part pointed out hereinafter.

In accordance with the invention, a slide to be partially inserted beneath a floor contact portion of a heavy structure such as a filing cabinet includes a flat plate and a non-slip pad. The flat plate is formed of an abrasion resistant lubric plastic material such as high molecular weight polyethylene and has an upper and a lower face joined by a rim. The non-slip pad is formed of natural or synthetic plastic material such as natural rubber and is adhesively fixed to and generally covers the upper face of the flat plate. In use, the rim of the slide not under the floor contact portion tends to bend upwardly to slide easily over the floor while the pad keeps the heavy structure from sliding off the slide.

The invention summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 3:
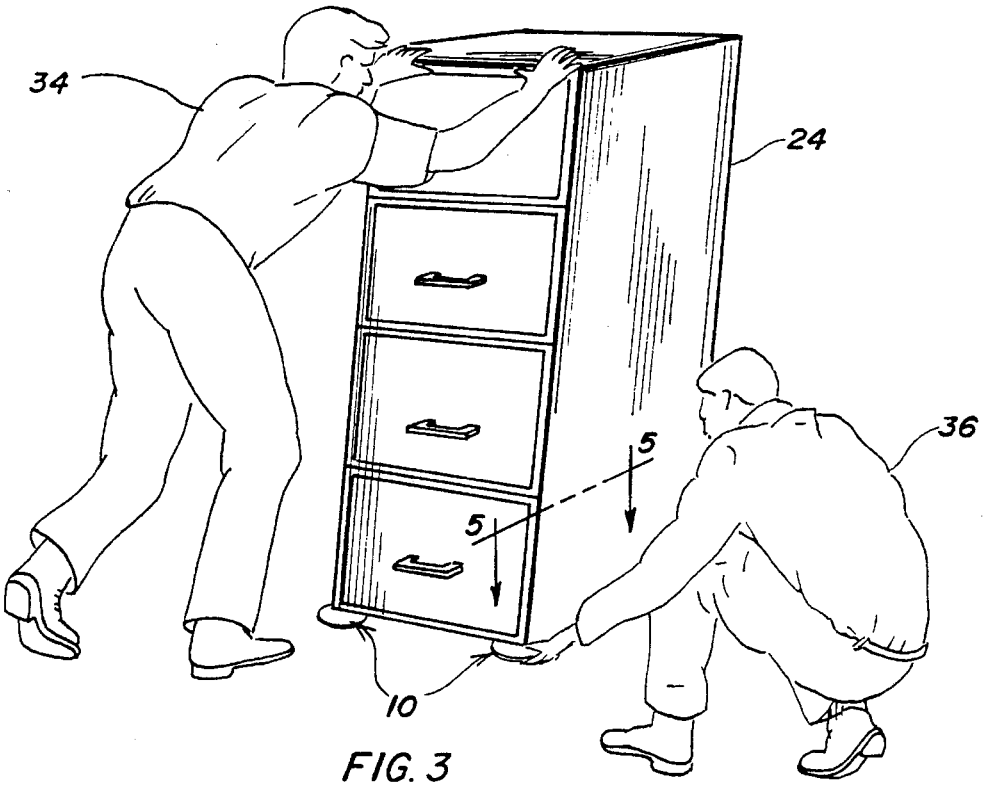
FIG. 3 is a perspective view of a pair of slides being inserted beneath a floor contact portion of a heavy structure such as a filing cabinet.
Figure 1:
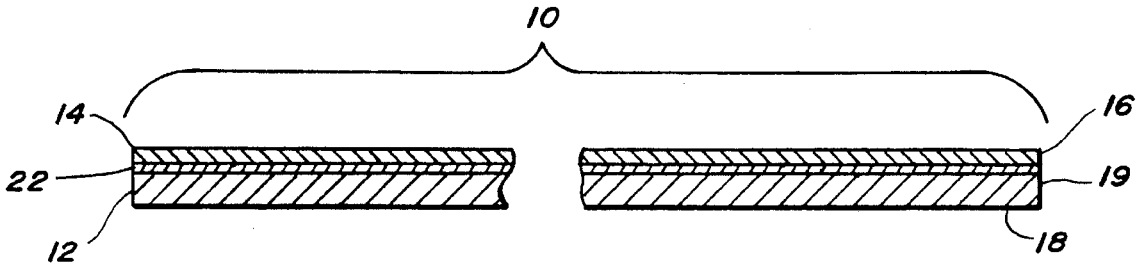
FIG. 1 an enlarged sectional view of a slide in accordance with the present invention.

Referring to the drawings more particularly by reference character, reference numeral 10 refers to a slide for moving heavy office files, furniture, equipment and the like. Slide 10 is formed as a laminar assembly including a flat plate 12 and a pad 14.

Flat plate 12 has an upper face 16 and a lower face 18 joined by a rim 19 and is made of an abrasion resistant lubric plastic material. Suitable materials include ultra high molecular weight polyethylene sold under the trademark TIVAR or the like. (TIVAR is a registered trademark owned by Poly-Hi/Menasha Corporation). Ultra high molecular weight polyethylene (e.g., TIVAR-100) is resilient and has high stock strength, properties that minimize the possibility that plate 12 will crack or break in use. Other suitable materials for flat plate 12 should have substantially the same physical properties as TIVAR-100 in coefficient of friction, abrasion resistance and flexibility. TIVAR-100, for example, has a static and dynamic coefficient of friction against steel of 0.18 and 0.13, respectively (USTM method D1894), an abrasion index of 10 (USTM sand slurry method relative to steel at 100) and a modulus of elasticity in tension of 1.02 (USTM method D747, $10^3$ p.s.i.). Other plastics with a coefficient of static and dynamic friction equal to or less than about 0.18 and 0.13, an abrasion index equal to or greater than about 10 and a modulus of elasticity equal to or greater than about 1.02 may be suitable. Candidates include some polytetrafluroethylenes (e.g., TEFLON), some nylons or copolyesters but from the standpoint of cost relative to performance, ultra high molecular weight polyethylene is preferred.

Flat plate 12 is preferably about 0.05 inch to about 0.15 inch thick. Commercially available high molecular weight polyethylene is available in sheets 1/16, 3/32 and ⅛ inch thick from which plates 12 may be cut. Thinner plates 12 (e.g., 0.05 inch) are preferred for use on glue down or modular carpet whereas thicker plates (e.g., 0.15 inch) are preferred when slide 10 is used on a masonry or tile floor or on plush carpeting.

It is also important that slide 10 not plow into a carpet 20 or the like, hence the leading edge of plate 12 is preferably continuously convex. More particularly, flat plate 12 is preferably generally circular in plan and has a diameter from about 4 inches to about 10 inches with a diameter of about 6 inches being preferred for most applications. If the plate is under 3 inches in diameter it is too small for use in moving heavy furniture, whereas diameters greater than 12 inches should be avoided because there is too much friction with the floor.

Pad 14 is made from a layer of tough natural or synthetic plastic material. To facilitate insertion of slide 10 under heavy structures, it is important that slide 10 be as thin as possible, hence the thickness of pad 14 should be minimized, consistent with providing a pad that does not tear in use. Suitable materials include natural rubber sold by Griswold Rubber Company, Inc. for use as jar openers. It is preferred that pad 14 be from about 0.05 inch to about 0.15 inch thick. Griswold item 9231, for example, is from about 0.04 inch to about 0.06 inch thick, has a texturized surface 21 (e.g., cross-hatched belt impression) and is made from natural rubber. When surface 21 is smooth, it can be imprinted with an advertising message or the like if desired.

Figure 2:
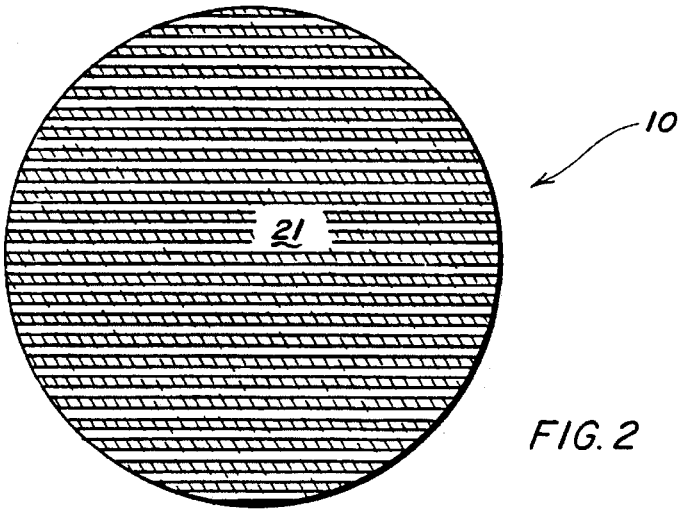
FIG. 2 is a reduced plan view of the slide.

Pad 14 is of a size and shape to generally cover upper face 16 of flat plate 12. Pad 14 is adhesively attached to flat plate 12 by means of an adhesive layer 22 shown in FIG. 2, exaggerated in size relative to the thickness of plate 12 and pad 14. Adhesive 22 must be capable of laminating to natural rubber, synthetic rubber and other low surface energy plastics such as untreated polyethylene, etc. An adhesive tape sold by Venture Tape Corporation under the trademark VENTURE TAPE, product No. 3853, is satisfactory. The tape is 3.0 mils thick and has excellent quick stick capabilities to most surfaces and good resistance to shear stress.

Figure 4:
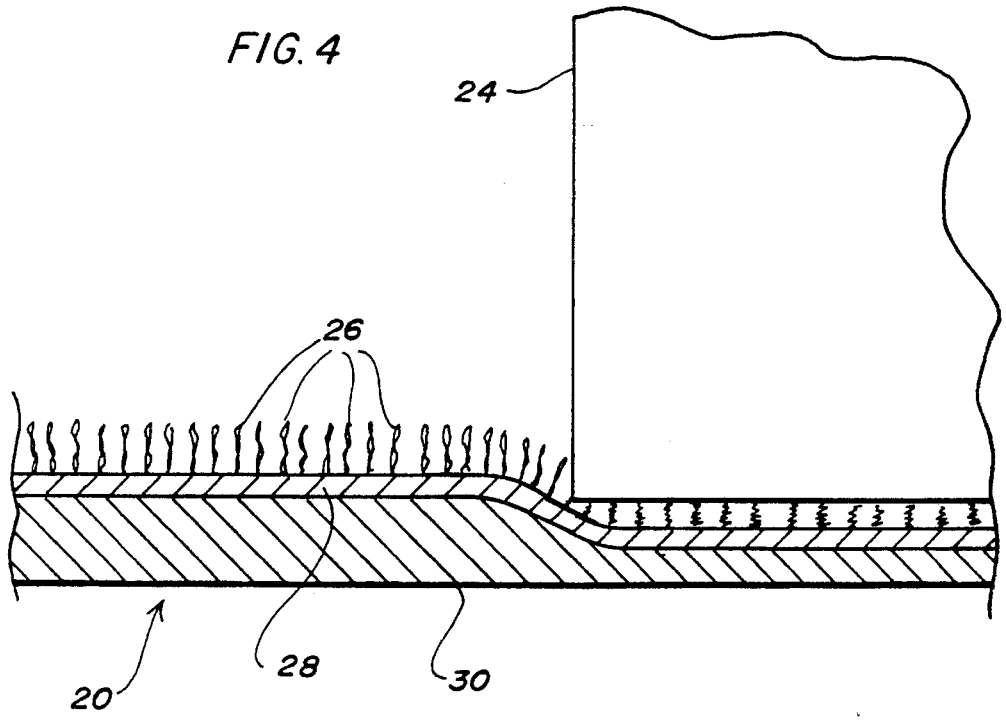
FIG. 4 is a sectional view of the heavy structure sitting on a carpet.
Figure 5:
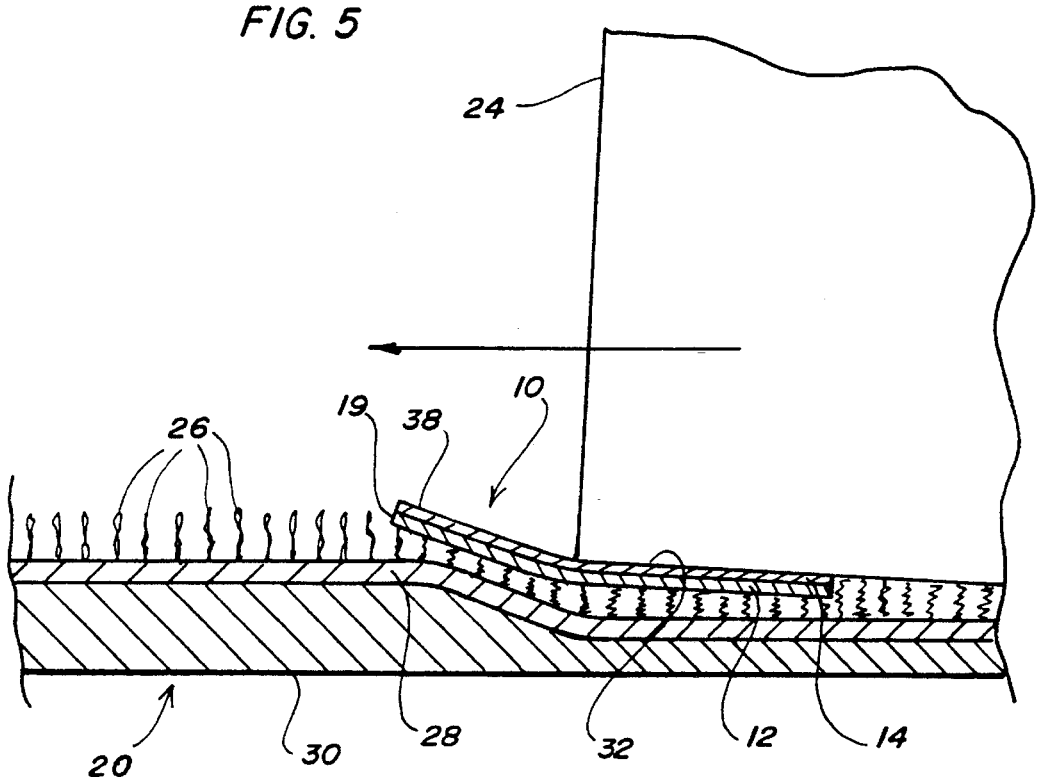
FIG. 5 is a sectional view taken along line 5—5 in FIG. 3 showing the slide under the floor contact portion of the heavy structure.

As shown in FIG. 4, filing cabinet 24 is shown sitting on carpet 20 which includes a fiber piling 26 attached to a backing 28 over a sponge rubber pad 30. Cabinet 24 is indented into the carpet. In use as shown in FIGS. 3 and 5, slide 10 is inserted beneath a floor contact portion 32 of a heavy structure such as filing cabinet 24 or the like. To accomplish this operation, a first worker 34 pivots cabinet 24 about its base by pushing the cabinet up and back along the top front. While the cabinet 24 is reared up, a second worker 36 slips one of slides 10 partially under floor contact portion 32 at each of the front corners. Alternatively, first worker 34 may simply push slides 10 under the cabinet with his foot.

With continuing reference to FIGS. 3 and 5, it is seen that about ¼ to ½ of slide 10 is not under cabinet 24, forming a free portion 38 that flexes upwardly in inclined relationship under the upward force of carpet 20. With slides 10 under the front corners, cabinet 24 can be easily slid away from a wall against which it is standing. As cabinet 24 slides in the direction of the arrow in FIG. 5, free inclined portion 38 helps the cabinet to slide out of the indent into which the cabinet naturally settles. A second set of slides can then be inserted under the rear corners, if desired.

Because of the heavy weight of the structure being moved, lower face 18 of plate 12 tends to get very hot as it slid across a floor so that the material selected for the plate must be capable of withstanding high temperatures without blistering or otherwise deforming. Ultra high molecular weight polyethylene has been found entirely satisfactory and is therefore preferred for this reason in addition to its desirable characteristics of lubricity, abrasion resistance and flexibility.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A slide to be partially inserted beneath a floor contact portion of a heavy structure to enable easy sliding, said slide comprising a flexible generally flat plate formed of ultra high molecular weight polyethylene having an abrasion resistance equal to or greater than 10 (USTM sand slurry method) and a non-slip pad formed of synthetic plastic material, said flat plate being about 0.05 inch to about 0.15 inch thick, having a diameter between about 4 inches and about 10 inches, and having an upper face and a lower face joined by a rim, said pad adhesively fixed to and generally covering the upper face of the plate whereby the rim of the slide not under the floor contact portion tends to bend upwardly to slide easily over the floor while the pad keeps the heavy structure from sliding off the slide.

2. The slide of claim 1 wherein the ultrahigh molecular weight polyethylene has a static and a dynamic coefficient of friction against steel (USTM D1894) equal to or less than about 0.18 and about 0.13, respectively.

3. The slide of claim 2 wherein the ultrahigh molecular weight polyethylene has a modulus of elasticity in tension equal to or greater than about 1.02 (USTM D747).

4. The slide of claim 1 wherein the plate has continuously convex leading edges.

* * * * *